US007111965B2

(12) United States Patent
Hsu

(10) Patent No.: US 7,111,965 B2
(45) Date of Patent: Sep. 26, 2006

(54) LAMP CLAMP

(76) Inventor: Huang-Hsi Hsu, 8F., No. 14, Lane 252, Chungshan N. Rd., Sec. 6, Taipei (TW)

( * ) Notice: Subject to any disclaimer, the term of this patent is extended or adjusted under 35 U.S.C. 154(b) by 68 days.

(21) Appl. No.: 10/965,842

(22) Filed: Oct. 18, 2004

(65) Prior Publication Data

US 2006/0083009 A1 Apr. 20, 2006

(51) Int. Cl.
*F21V 21/00* (2006.01)

(52) U.S. Cl. ..... 362/396; 362/191; 362/202

(58) Field of Classification Search ..... 362/190–191, 362/396, 436, 438, 439
See application file for complete search history.

(56) References Cited

U.S. PATENT DOCUMENTS 4,288,848 A * 9/1981 Fido ..... 362/378
5,180,220 A * 1/1993 Van Kalsbeek ..... 362/98
5,823,657 A * 10/1998 Price et al. ..... 362/191
5,823,658 A * 10/1998 Doddy ..... 362/191
6,536,911 B1 * 3/2003 DiAngelo ..... 362/190

* cited by examiner

*Primary Examiner*—Ali Alavi
(74) *Attorney, Agent, or Firm*—Bacon & Thomas, PLLC

(57) ABSTRACT

The present invention is to provide a device for holding and fastening a light-emitting member, comprising a fastening assembly including a first space for receiving and clamping an object; and a secureness assembly provided on the fastening assembly and having a second space for receiving and fastening a portion of the light-emitting member, enabling both the light-emitting member and the device to be easily carried after the light-emitting member being detaching from the secureness assembly and the fastening assembly being disengaged from an object.

10 Claims, 4 Drawing Sheets

LAMP CLAMP

FIELD OF THE INVENTION

The present invention relates to clamps and more particularly to an improved clamp for holding and fastening a lamp or a flashlight so as to facilitate work.

BACKGROUND OF THE INVENTION

A conventional flashlight 1 is shown in FIG. 1 and comprises a case 10, a rotating joint 11 pivotably provided at a front end of the case 10, the rotating joint 11 being adapted to rotate about a longitudinal axis of the case 10, two opposite conductive arms 12 and 13 provided on a head assembly, a bulb carrier assembly 14 pivotably provided in the head assembly between the arms 12 and 13, the bulb carrier assembly 14 being adapted to rotate about a longitudinal axis thereof between the arms 12 and 13, and at least one battery (two are shown) 15 provided in the case 10 for supplying power to a bulb 141 of the bulb carrier compartment 14 for emitting light. The emitted light is adapted to change its projecting direction by rotating both the rotating joint 11 and the bulb carrier compartment 14.

Also, an on/off switch 16 is provided on an outer surface of the case 10. The switch 16 has one end extended into an inner surface of the case 10. Moreover, a circuit 17 is formed in the flashlight 1 and is extended from a positive terminal of a lower battery 15 to one end of the switch 16 along the inner surface of the case 10. From the switch 16, the circuit 17 further extends to the arm 12, the bulb 141 of the bulb carrier compartment 14, the other arm 13, and a negative terminal of an upper battery 15. The switch 16 is operative to enable or disable the circuit 17. In the enabled state of the circuit 17, electric power of the batteries 15 is supplied to the bulb 141 of the bulb carrier compartment, 14 for emitting light directed to an object.

For example, a worker has to hold the case 10 and direct light emitted from the bulb 141 of the bulb carrier compartment 14 with one hand and use the other hand to repair a malfunctioned device on a machine table being illuminated by the flashlight. This is inconvenient.

Thus, it is desirable to provide a clamp for holding and fastening a lamp or flashlight so as to facilitate repairing of a malfunctioned device on a machine table being illuminated by the lamp or flashlight because both hands of a worker are free.

SUMMARY OF THE INVENTION

After considerable research and experimentation, a clamp for holding and fastening a lamp or a flashlight according to the present invention has been devised so as to overcome the above drawback of the prior art (i.e., only one hand is available to repair a malfunctioned device on a machine table and such is insufficient and inconvenient).

It is an object of the present invention to provide a device for holding and fastening a light-emitting member, comprising a fastening assembly including a first space for receiving and clamping an object; and a secureness assembly provided on the fastening assembly, the secureness assembly including a second space for receiving and fastening a portion of the light-emitting member. By utilizing the present invention, for example repairing of a malfunctioned device on a machine table being illuminated by the light-emitting member can be facilitated because both hands of a worker are free. Moreover, both the light-emitting member and the device can be easily carried after detaching the light-emitting member from the secureness assembly and disengaging the fastening assembly from the object.

The above and other objects, features and advantages of the present invention will become apparent from the following detailed description taken with the accompanying drawings.

DETAILED DESCRIPTION OF THE PREFERRED EMBODIMENTS

Figure 1:
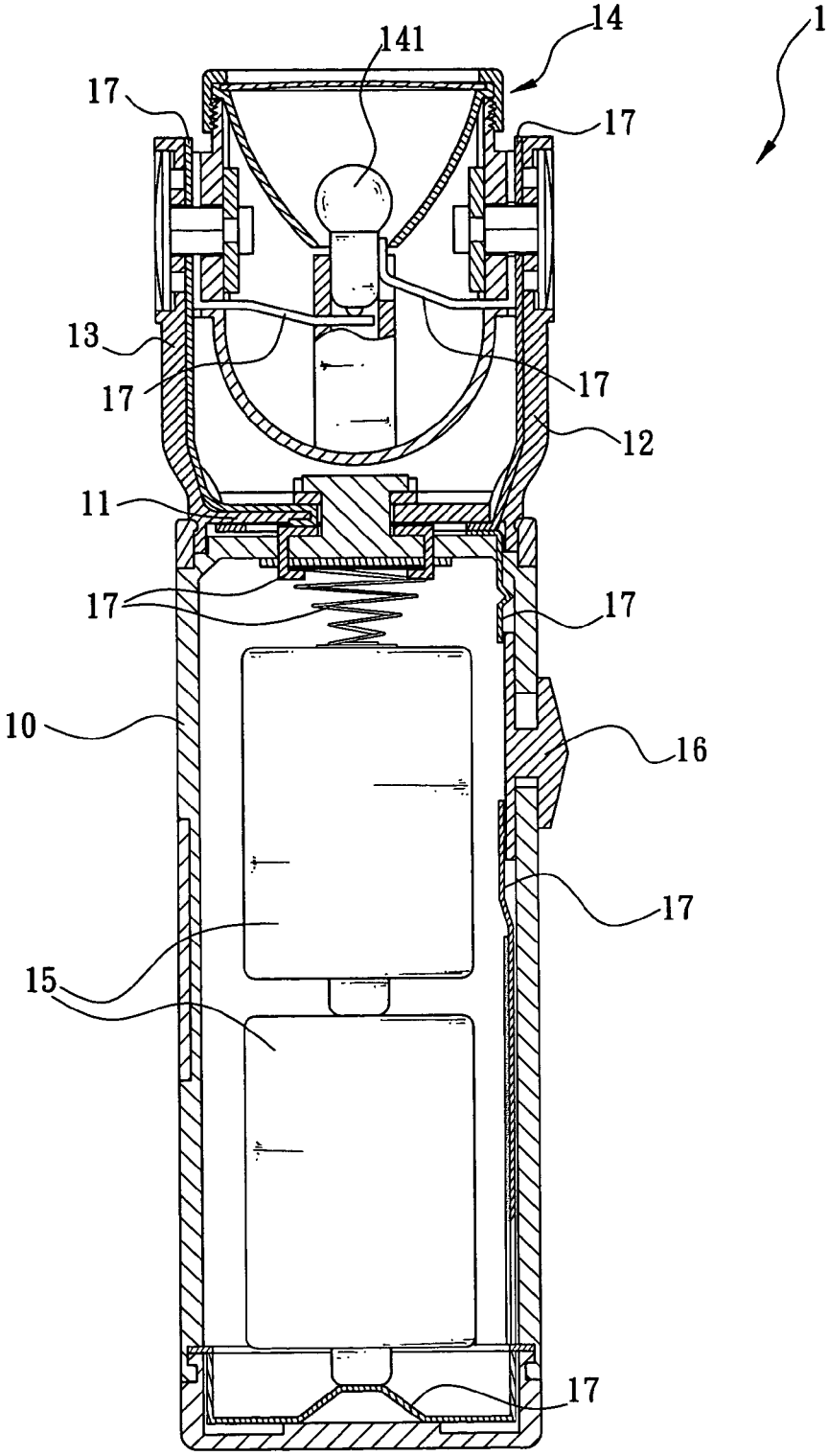
FIG. 1 (Prior Art)
FIG. 1 is a sectional view of a conventional flashlight.
Figure 2:
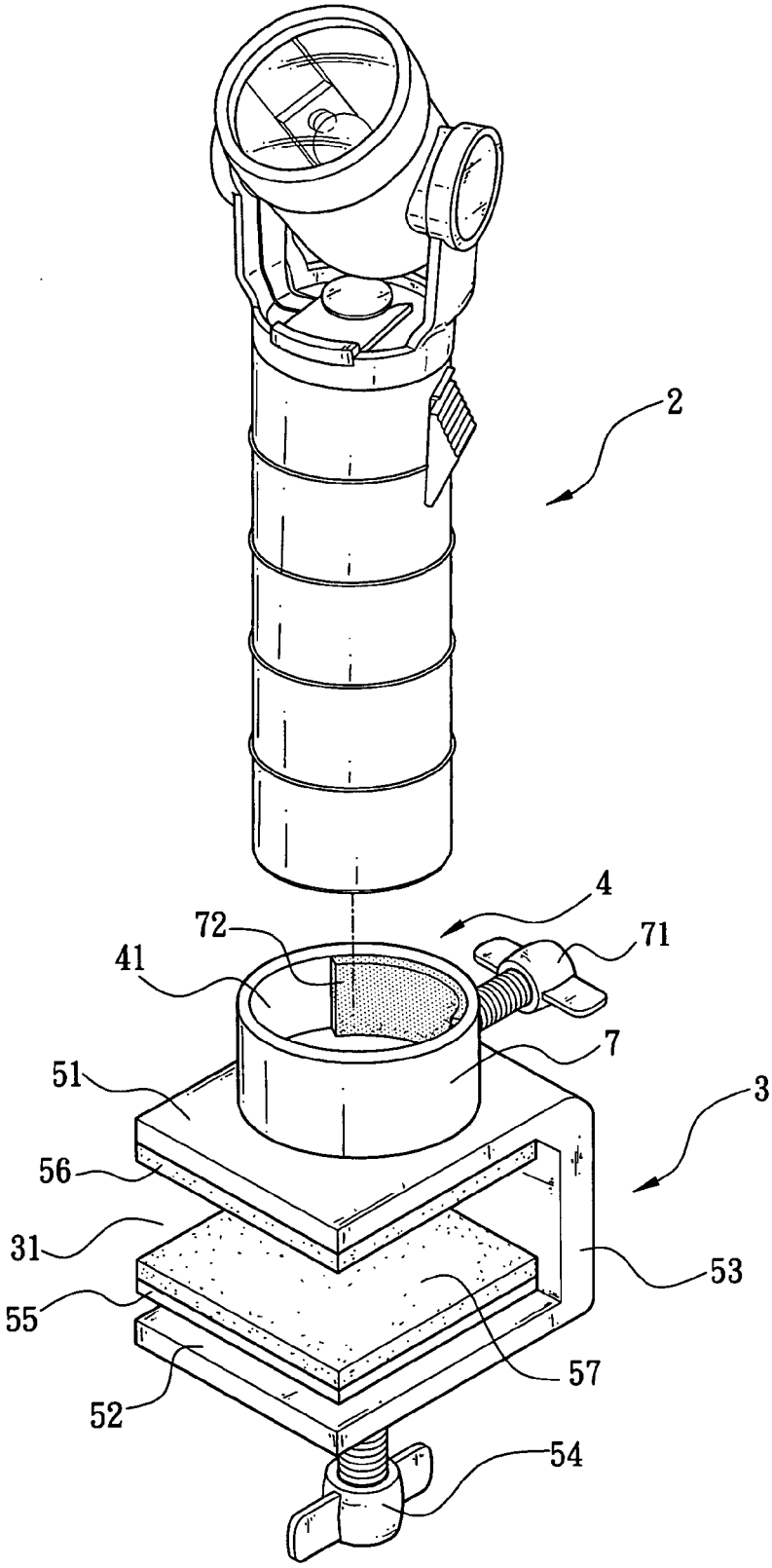
FIG. 2 is a perspective view of a first preferred embodiment of clamp according to the invention, where the clamp is about to fasten a flashlight thereon.

Referring to FIG. 2, there is shown a lamp clamp constructed in accordance with a first preferred embodiment of the invention comprising a fastening assembly 3 including a first space 31 for clamping an object (e.g., a desk, the sidewall of a barbeque, a book shelf, or the table of a tool machine). As such, the object is clamped and fastened by the fastening assembly 3. A secureness assembly 4 is provided on a top of the fastening assembly 3. The secureness assembly 4 comprises a second space 41 for accommodating a lower portion of a light-emitting member (e.g., flashlight as shown) 2. Further, the light-emitting member 2 can be fastened in the second space 41 of the secureness assembly 4 as detailed later. Once the object is fastened by the fastening assembly 3 and the light-emitting member 2 is fastened by the secureness assembly 4, both hands of a worker are free to do things with the help of the enabled light-emitting member 2.

Referring to FIG. 2 again, in the first preferred embodiment of the invention the fastening assembly 3 comprises an upper plate 51, a lower plate 52, and a side plate 53 interconnected the upper and the lower plates 51 and 52. The first space 31 is thus defined by the plates 51, 52, and 53. The secureness assembly 4 is provided on a top of the upper plate 51 opposite the first space 31. A wing screw 54 is driven upward through the lower plate 52 into the fastening assembly 3 from below. The wing screw 54 is adapted to extend into or withdraw from the first space 31 by a clockwise or counterclockwise rotation respectively. As such, a tip of the wing screw 54 can move toward the upper plate 51 or the lower plate 52. In a case of the wing screw 54 rotated to move the tip thereof toward the upper plate 51, the object in the first space 31 is biased by the tip of the wing screw 54 so as to clamp the object by the cooperating upper plate 51 and the wing screw 54. In such a manner, the object is clamped by the fastening assembly 3 and the light-emitting member 2 is fastened by the secureness assembly 4 above the object.

Referring to FIG. 2 again, in the embodiment a moveable plate 55 is formed in the first space 31 and is disposed on a top of the tip of the wing screw 54. A first pad (e.g., silica-gel spacer or soft rubber) 56 is provided on a bottom of the upper plate 51 opposite the lower plate 52. A second pad 57 is provided on a top of the moveable plate 55 and is above the lower plate 52. The facing surfaces of the pads 56 and 57 are implemented as flat, corrugated, or toothed ones. As such, the moveable plate 55 is adapted to move toward the upper plate 51 or the lower plate 52 in response to turning the wing screw 54 in either direction. In a case of the moveable plate 55 moved toward the upper plate 51, the object in the first space 31 is clamped by the first pad 56 under the upper plate 51 and the second pad 57 on the moveable plate 55. As a result, the object is fastened in the fastening assembly 3.

Figure 4:
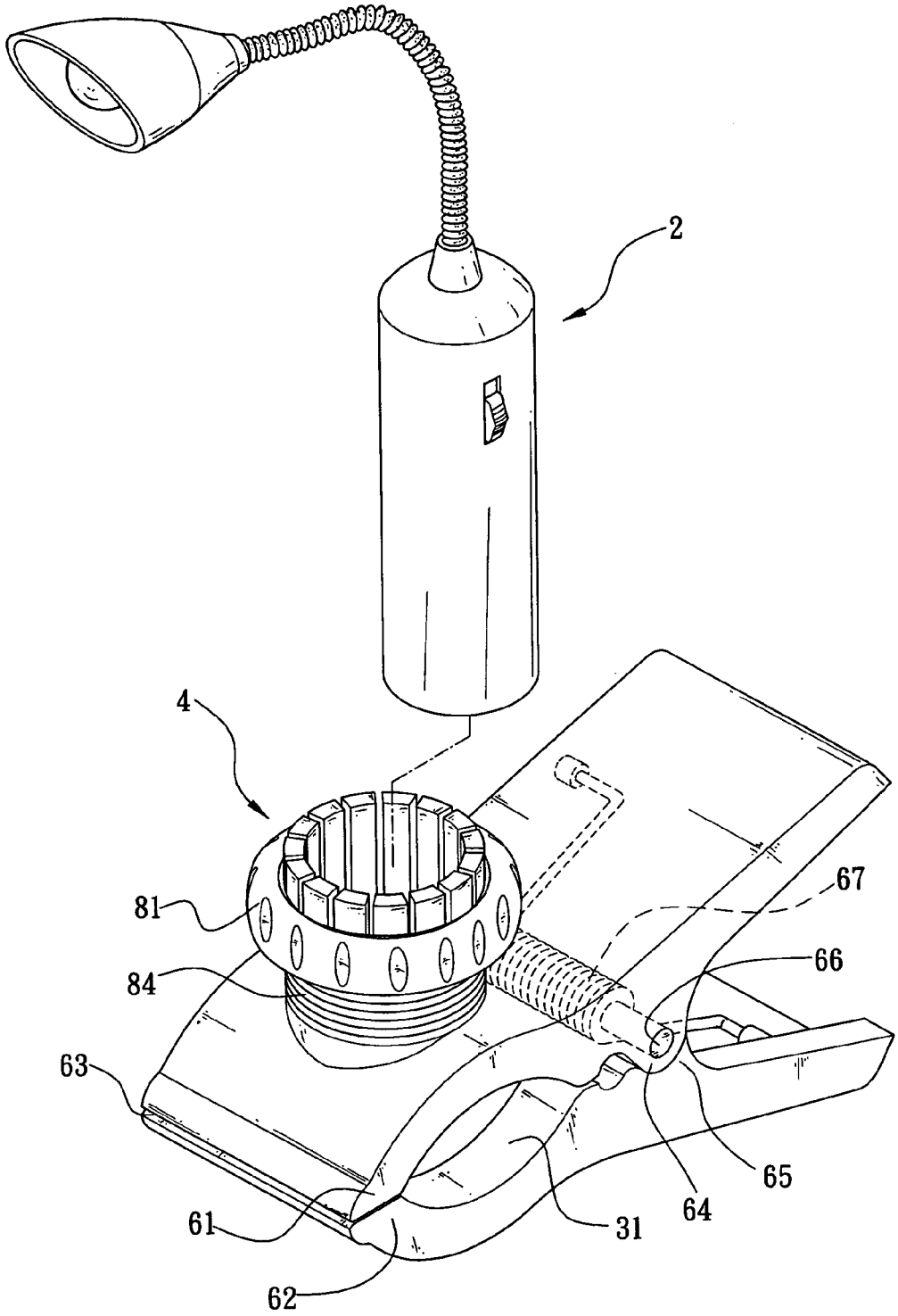
FIG. 4 is a perspective view of a third preferred embodiment of clamp according to the invention, where the clamp is about to fasten a lamp thereon.

Referring to FIG. 4, a third preferred embodiment of the invention is shown. The characteristics of the third preferred embodiment are detailed below. The fastening assembly 3 comprises an upper curved plate 61 and a lower curved plate 62. An opening 63 is formed by opposing jaws at one ends of the upper curved plate 61 and the lower curved plate 62. An intermediate member 64 is formed at either side of the upper curved plate 61. An intermediate mated member 65 is formed at either side of the lower curved plate 62. A hinge shaft 66 is provided between the upper curved plate 61 and the lower curved plate 62 and is across the intermediate members 64 (or the mated intermediate members 65) such that the upper curved plate 61 and the lower curved plate 62 can be pivotably coupled together. A first space 31 is formed between the hinge shaft 66 and the opening 63 and is defined by the upper curved plate 61 and the lower curved plate 62. A secureness assembly 4 is formed on an outer surface of the upper curved plate 61 opposite the lower curved plate 62 and spaced from the first space 31.

A coil spring 67 is provided around the hinge shaft 66. The coil spring 67 is adapted to open or close the opening 63 by either pressing the other ends (i.e., opposing the opening 63) of the upper curved plate 61 and the lower curved plate 62 toward each other or not. Once the opening 63 is open, an object can be placed in the first space 31. Next, a releasing of the pressing will close the opening 63 due to the compression of the stored elastic force of the coil spring 67. As a result, the object is clamped at the opening 63.

Referring to FIG. 2 again, in the embodiment the secureness assembly 4 is implemented as a cylindrical socket 7 formed on a top of the fastening assembly 3. A top of the socket 7 is open to communicate the second space 41 in the socket 7 with the external. A second wing screw 71 is further provided and is laterally driven through the socket 7. The second wing screw 71 is adapted to extend into or withdraw from the second space 41 by a clockwise or counterclockwise rotation respectively. As such, a tip of the second wing screw 71 in the second space 41 can continuously move toward a lower portion of the light-emitting member 2 in the second space 41 until the light-emitting member 2 is clamped by the second wing screw 71 and the inner surface of the socket 7.

Moreover, a moveable pad (e.g., silica-gel spacer, soft rubber, or hard rubber) 72 is provided on the inner surface of the socket 7. In response to turning the second wing screw 71, the pad 72 together with the tip of the second wing screw 71 move from the inner surface of the socket 7 toward a center of the second space 41. As such, the pad 72 can continuously move toward the lower portion of the light-emitting member 2 in the second space 41 until the light-emitting member 2 is clamped by the pad 72 and the inner surface of the socket 7. As a result, the light-emitting member 2 is clamped by the secureness assembly 4.

Figure 3:
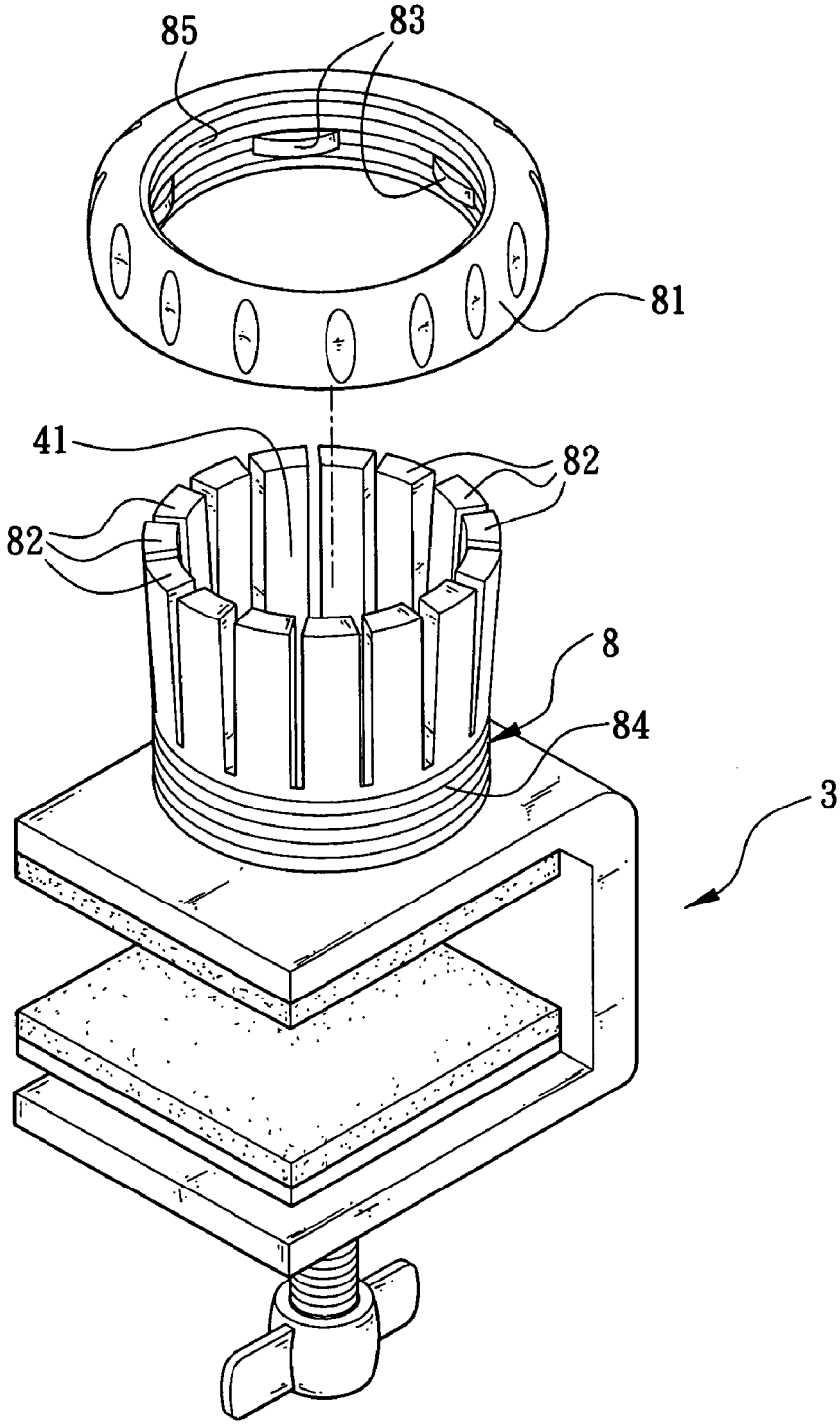
FIG. 3 is an exploded perspective view of a second preferred embodiment of clamp according to the invention.

Referring to FIG. 3, a second preferred embodiment of the invention is shown. The second preferred embodiment substantially has same structure as the first preferred embodiment. The differences between the first and the second preferred embodiments, i.e., the characteristics of the second preferred embodiment are detailed below. The secureness assembly 4 comprises a cylindrical receptacle 8 formed on a top of the fastening assembly 3, the receptacle 8 including a plurality of spaced, peripheral latches 82 extended upward to define a second space 41 therein, and a ring member 81 put on the latches 82, the ring member 81 including a plurality of spaced, curved projections 83 around its inner surface. In response to inserting the lower portion of the light-emitting member (e.g., lamp as shown in FIG. 4) 2 into the second space 41, turn the ring member 81 to be away from the fastening assembly 3 until the latches 82 are tightly urged by the projections 83. In this position, radial displacements of the latches 82 (i.e., toward the light-emitting member 2) can clamp the light-emitting member 2 therein. As a result, the light-emitting member 2 is fastened on the fastening assembly 3.

Moreover, external threads 84 are formed around a lower portion of the receptacle 8 adjacent the fastening assembly 3. Correspondingly, internal threads 85 are formed around the inner surface of the ring member 81. As such, the internal threads 85 can be threadedly secured to the external threads 84 when the ring member 81 is put on the receptacle 8 and is turned downward with respect thereto. As a result, the ring member 81 is secured to the receptacle 8. Moreover, at this position (i.e., the ring member 81 has been positioned after turning), the ring member 81 contracts inward to secure the light-emitting member 2 to the secureness assembly 4.

While the invention herein disclosed has been described by means of specific embodiments, numerous modifications and variations could be made thereto by those skilled in the art without departing from the scope and spirit of the invention set forth in the claims.

What is claimed is:

1. A device for holding and fastening a light-emitting member, comprising:

a fastening assembly including a first space for receiving and clamping a portion of an object; and a secureness assembly provided on the fastening assembly spaced from the first space, the secureness assembly including a second space for receiving and fastening a portion of the light-emitting member;

wherein the fastening assembly further comprises:

a first curved plate including an intermediate member formed at either side;

a second curved plate including a mated intermediate member formed at either side;

an opening formed at one ends of the first and the second curved plates;

a hinge shaft provided between the first and the second curved plates, the hinge shaft being across both the intermediate members and the mated intermediate members so as to pivotably couple the first curved plate to the second curved plate; and a third space formed between the hinge shaft and the opening and defined by the first and the second curved plates, wherein the secureness assembly is formed on an outer surface of the first curved plate opposite the second curved plate.

2. The device of claim 1, further comprising a coil spring provided around the hinge shaft, the coil spring being adapted to open or close the opening by either pressing the other ends of the first and the second curved plates toward each other or not.

3. The device of claim 1, wherein the secureness assembly further comprises:

a socket formed on the fastening assembly, the socket including an open top to expose the second space; and a wing screw laterally driven through the socket from external such that either clockwise rotating the wing screw to extend into the second space will clamp the light-emitting member by a tip of the wing screw moving toward the light-emitting member in the second space and an inner surface of the socket, or counterclockwise rotating the wing screw will withdraw the wing screw from the second space.

4. The device of claim 3, further comprising a moveable pad provided on the inner surface of the socket proximate the tip of the wing screw wherein responsive to turning the wing screw, the moveable pad together with the tip of the wing screw move toward a center of the second space.

5. The device of claim 1, wherein the secureness assembly further comprises:

a receptacle formed on the fastening assembly, the receptacle including a plurality of spaced, peripheral latches extended upward to define the second space therein; and a ring member put on an outer surface of the receptacle, the ring member including a plurality of spaced projections around its inner surface tightly urged against the latches.

6. The device of claim 5, wherein the receptacle further comprises external threads formed therearound adjacent the fastening assembly, and the ring member further comprises internal threads formed around an inner surface, the internal threads being adapted to threadedly secure to the external threads.

7. A device for holding and fastening a light-emitting member, comprising:

a fastening assembly including a first space for receiving and clamping a portion of an object; and a secureness assembly provided on the fastening assembly spaced from the first space, the secureness assembly including a second space for receiving and fastening a portion of the light-emitting member;

wherein the secureness assembly further comprises: a socket formed on the fastening assembly, the socket including an open top to expose the second space; and a wing screw laterally driven through the socket from external such that either clockwise rotating the wing screw to extend into the second space will clamp the light-emitting member by a tip of the wing screw moving toward the light-emitting member in the second space and an inner surface of the socket, or counterclockwise rotating the wing screw will withdraw the wing screw from the second space.

8. The device of claim 7, further comprising a moveable pad provided on the inner surface of the socket proximate the tip of the wing screw wherein responsive to turning the wing screw, the moveable pad together with the tip of the wing screw move toward a center of the second space.

9. A device for holding and fastening a light-emitting member, comprising:

a fastening assembly including a first space for receiving and clamping a portion of an object; and a secureness assembly provided on the fastening assembly spaced from the first space, the secureness assembly including a second space for receiving and fastening a portion of the light-emitting member, and wherein the secureness assembly further comprises:

a receptacle formed on the fastening assembly, the receptacle including a plurality of spaced, peripheral latches extended upward to define the second space therein; and a ring member put on an outer surface of the receptacle, the ring member including a plurality of spaced projections around its inner surface tightly urged against the latches.

10. The device of claim 9, wherein the receptacle further comprises external threads formed therearound adjacent the fastening assembly, and the ring member further comprises internal threads formed around an inner surface, the internal threads being adapted to threadedly secure to the external threads.

* * * * *